US009585529B2

(12) United States Patent
Mulford et al.

(10) Patent No.: US 9,585,529 B2
(45) Date of Patent: Mar. 7, 2017

(54) TOILET TRAINING DEVICE

(71) Applicants: Frederick Mulford, Melbourne Beach, FL (US); Elna Mulford, Melbourne Beach, FL (US)

(72) Inventors: Frederick Mulford, Melbourne Beach, FL (US); Elna Mulford, Melbourne Beach, FL (US)

( * ) Notice: Subject to any disclaimer, the term of this patent is extended or adjusted under 35 U.S.C. 154(b) by 0 days.

(21) Appl. No.: 15/180,703

(22) Filed: Jun. 13, 2016

(65) Prior Publication Data

US 2016/0360938 A1 Dec. 15, 2016

Related U.S. Application Data

(60) Provisional application No. 62/174,986, filed on Jun. 12, 2015.

(51) Int. Cl.
*E03D 11/00* (2006.01)
*A47K 17/02* (2006.01)

(52) U.S. Cl.
CPC ..... *A47K 17/028* (2013.01)

(58) Field of Classification Search
CPC ..... A47K 17/02
USPC ..... 4/254, 483, 902
See application file for complete search history.

(56) References Cited

U.S. PATENT DOCUMENTS

| | | | | | |
|---|---|---|---|---|---|
| 1,085,468 | A | * | 1/1914 | Nixon | A47K 17/026 4/239 |
| 4,777,672 | A | | 10/1988 | Gebhard et al. | |
| D307,629 | S | * | 5/1990 | Takahashi | D23/296 |
| D568,974 | S | * | 5/2008 | McDowell | D23/296 |
| D570,461 | S | * | 6/2008 | Desnos-Simon | D23/296 |

OTHER PUBLICATIONS https://summerinfant.lbtest.summerinfant.com/littlelooster.
http://www.topkidsgear.com/the-best-potty-step-stool-with-handles-potty-stool-review/.
http://toddlertreasure.com/category/toddler-gear/toddler-potty-seats-and-chairs/.
http://www.primobaby.com/products/freedom-trainer#.V7S1y2BTGUk.

* cited by examiner

*Primary Examiner* — Huyen Le
(74) *Attorney, Agent, or Firm* — Mark Malek; Kelly G. Swartz; Widerman Malek, PL

(57) ABSTRACT

A toilet training device may include an ornamental support device and an attachment device. The ornamental support device may be adapted to rest upon a floor with a centerline of the ornamental support device aligned with a centerline of a toilet. The ornamental support device may include a footrest adapted to extend away from both sides of a centerline of the ornamental support device. The attachment device may be secured to the ornamental support device and adapted to removably secure to a toilet bowl basin rim.

18 Claims, 7 Drawing Sheets

TOILET TRAINING DEVICE

RELATED APPLICATIONS

This application claims the benefit under 35 U.S.C. §119 (e) of U.S. Provisional Patent Application Ser. No. 62/174,986 filed on Jun. 12, 2015 and titled Toilet Training Device, the entire contents of which are incorporated herein by reference.

FIELD OF THE INVENTION

The present invention relates to apparatus and methods for toilet training devices. Specifically, the present invention relates to a component that attaches to a conventional toilet and provides foot support and ornamentation to a child learning to use the toilet,

BACKGROUND

Existing toilet training devices include training toilets, child seats, stepstools, and ladders. Training toilets may be used as stand-alone miniaturized toilets. However, these must be emptied after use and are not used in combination with a conventional, flushable toilet. Child seats may be used in combination with traditional toilets to provide a seating are that is small enough to support a young child. However, child seats do not provide support for a child's limbs or emotional comfort to a child sitting upon the seat. Stepstools provide a way for children to access an adult size toilet. However, stepstools do not provide any arm support or emotional comfort for a child seated upon the toilet. Ladders may be similar to stepstools and extend higher than a stepstool. However, ladders do not provide emotional support or assist in keeping a child positioned on a toilet seat.

None of these existing devices provide familiarity or comfort to a child using a toilet. Additionally, none of the existing devices provide a support structure positioned in front of the child and above the location of the child's feet while the child is seated on the toilet A need exists for a device, which provides such emotional and physical support for a child learning to use an adult toilet.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, the present invention is directed to a toilet training device that is advantageously easy to install and provides a child entertainment during toilet training. The present invention also advantageously provides a toilet training device that can advantageously be used with an adult toilet without any reconfiguration of the adult toilet necessary.

These and other objects, features and advantages of the present invention are provided by a toilet training device adapted to be positioned proximate a toilet and to resemble an object familiar to the user. The toilet training device may include an ornamental support device and an attachment device. The ornamental support device may be adapted to rest upon a floor with a centerline of the ornamental support device aligned with a centerline of a toilet. The ornamental support device may include a footrest adapted to extend away from both sides of a centerline of the ornamental support device. The attachment device may be secured to the ornamental support device and adapted to removably secure to a toilet bowl basin rim.

The attachment device may include a spanning portion and a securing portion. The spanning portion may be secured to the ornamental support device. The securing portion may be secured to the spanning portion and adapted to extend toward a toilet bowl basin.

The ornamental support device may further include a first outer member, a second outer member, and a center member. The second outer member may oppose the first outer member. At least a portion of the center member may be secured between at least a portion of the first outer member and the second outer member. The center member may have ornamental indicia secured thereto.

The ornamental support device may further include a lower member, which may be secured between the first outer member and the second outer member. The lower member may be adapted to contact the floor and may have ornamental indicia secured thereto.

The toilet training device may include a handle secured to the ornamental support device. The handle may include a handlebar, a first handle grip, and a second handle grip. The handlebar may be adapted to extend through the first outer member and the second outer member. The first handle grip may be located on a first end of the handlebar. The second handle grip may be located on a second end of the handlebar. The first handle grip and the second handle grip may be hollow, elongate members adapted to carry an end portion of the handlebar and be grasped by a hand of a user.

The ornamental support device may further include a center connecting member. Only a portion of the center connecting member may be secured between a portion of the first outer member and a portion of the second outer member. The center connecting member may extend downwardly away from the first outer member and the second outer member. The attachment device may further include a spanning portion secured to the center connecting member and a securing portion secured to the spanning portion and adapted to extend into a toilet bowl basin.

The ornamental support device may further include a first outer connecting member and a second outer connecting member. The first outer connecting member may have a first outer connecting member first end abutting a portion of the first outer member along the entirety of the first outer connecting member first end. The second outer connecting member may have a second outer connecting member first end abutting a portion of the second outer member along the entirety of the second outer connecting member first end. The center connecting member may be secured between the first outer connecting member and the second outer connecting member.

The ornamental support device may further include a platform adapted to support a user. A top surface of the platform may be adjacent a first outer connecting member second end of the first outer connecting member. The top surface of the platform may be adjacent a second outer connecting member second end of the second outer connecting member. A first end of the center connecting member may be adjacent the top surface of the platform.

The top surface of the platform may be adjacent the first outer connecting member second end of the first outer connecting member along an entirety of the first outer connecting member second end. The top surface of the platform may be adjacent the second outer connecting member second end of the second outer connecting member along an entirety of the second outer connecting member second end. The first end of the center connecting member may be adjacent the top surface of the platform along an entirety of the first end of the connecting member.

The toilet training device may further include a first side support and a second side support. The first side support may be secured to a bottom side of the platform and adapted to contact the floor. The second side support may be secured to the bottom side of the platform and adapted to contact the floor.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
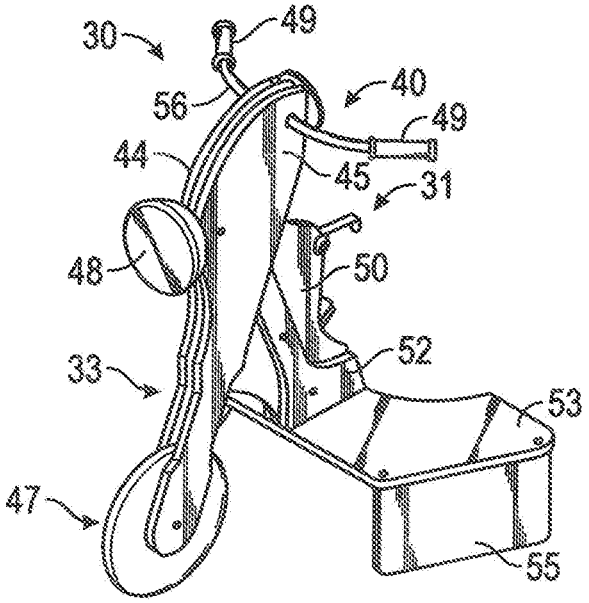
FIG. 1 is a side perspective view of a toilet training device according to an embodiment of the present invention.
Figure 2:
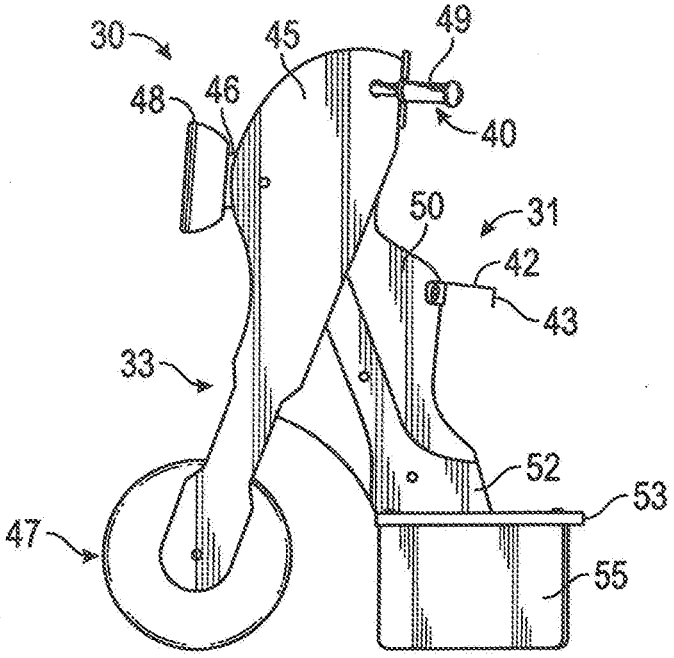
FIG. 2 is a side elevation view of the toilet training device illustrated in FIG. 1.
Figure 3:
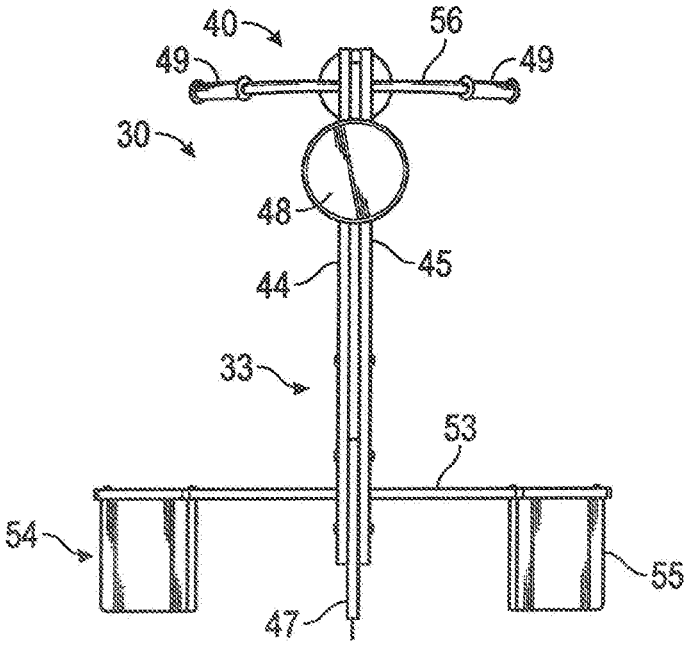
FIG. 3 is a front elevation view of the toilet training device illustrated in FIG. 1.
Figure 4:
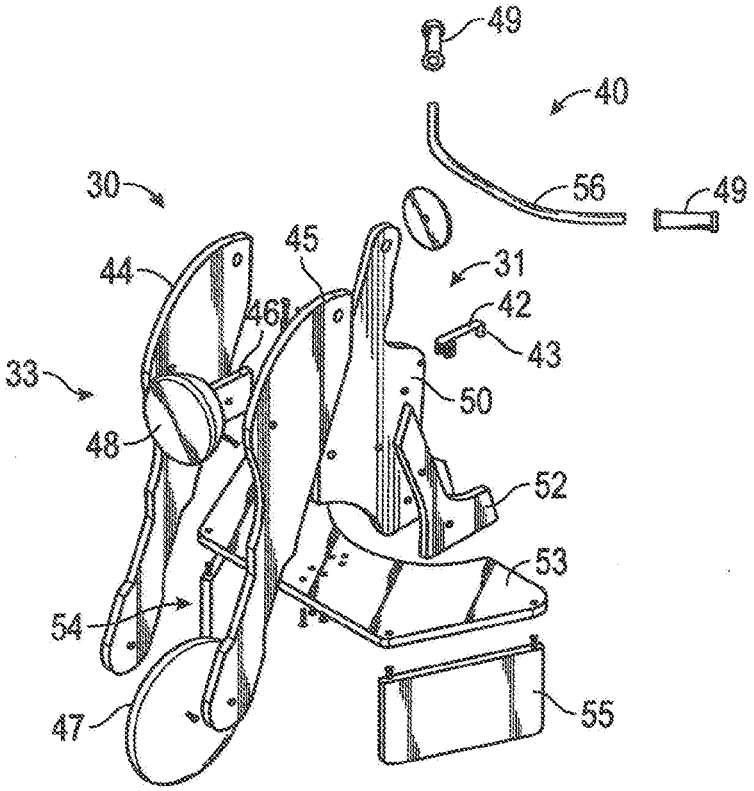
FIG. 4 is an exploded view of the toilet training device illustrated in FIG. 1.
Figure 5:
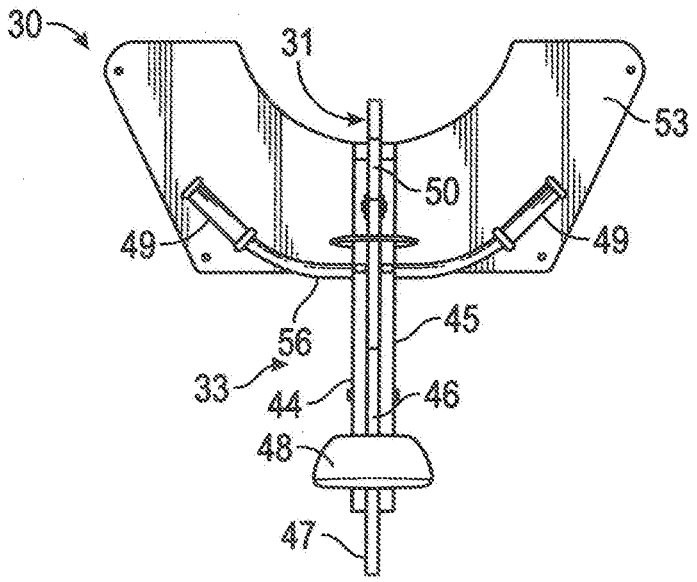
FIG. 5 is a top plan view of the toilet training device illustrated in FIG. 1.
Figure 6:
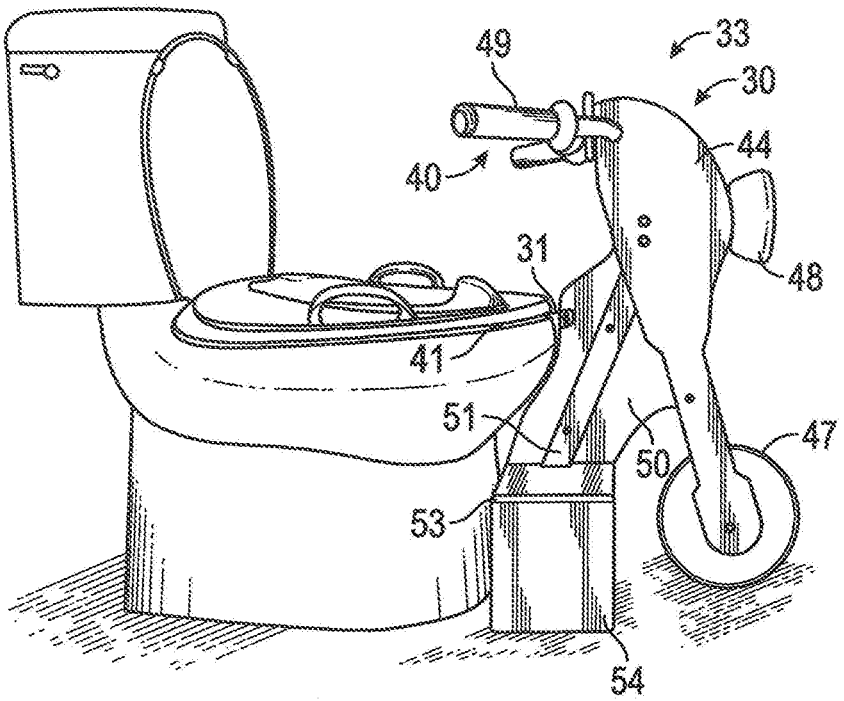
FIG. 6 is an environmental view of the toilet training device illustrated in FIG. 1 in combination with a toilet.
Figure 7:
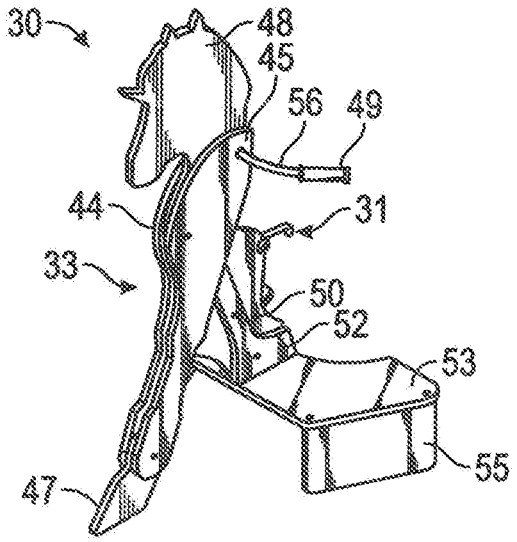
FIG. 7 is a side perspective view of a toilet training device according to an embodiment of the present invention.
Figure 8:
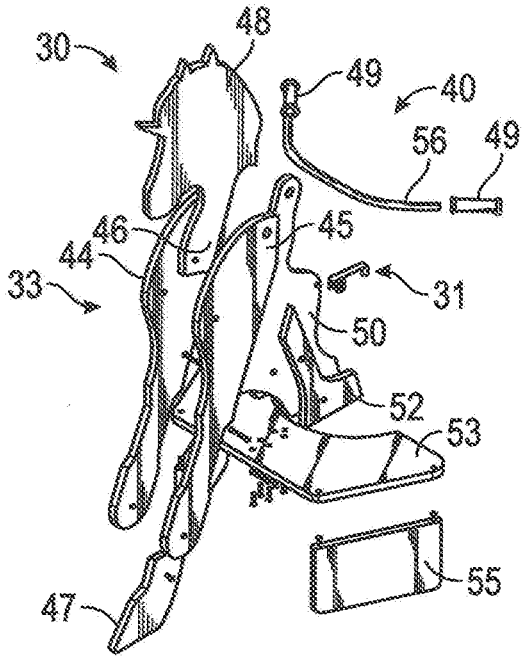
FIG. 8 is an exploded view of the toilet training device illustrated in FIG. 7.
Figure 9:
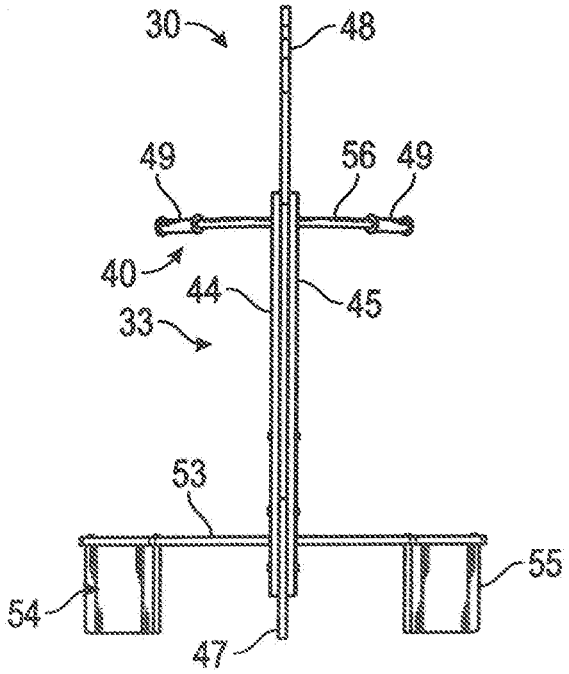
FIG. 9 is a front elevation view of the toilet training device illustrated in FIG. 7.
Figure 10:
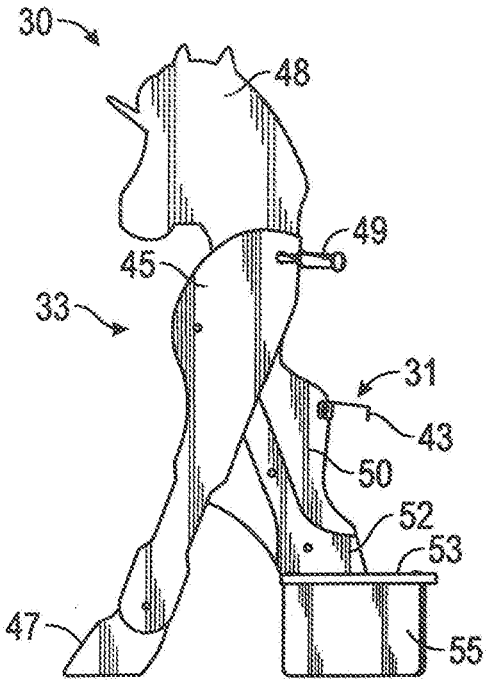
FIG. 10 is a side elevation view of the toilet training device illustrated in FIG. 7.
Figure 11:
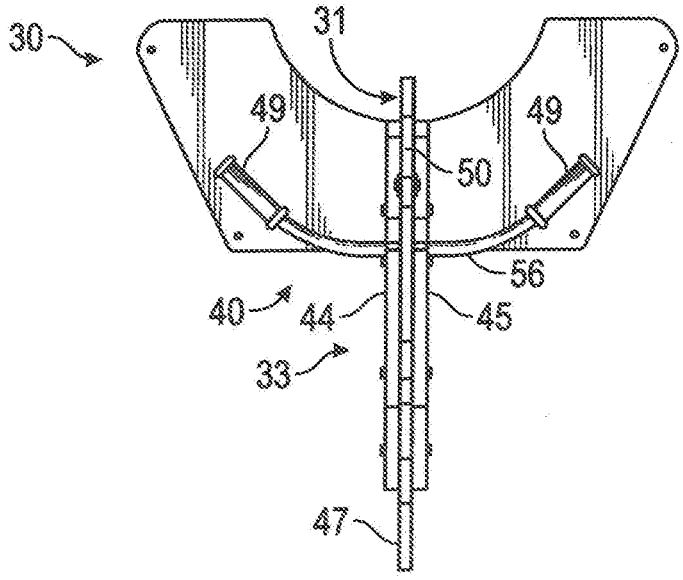
FIG. 11 is a top plan view of the toilet training device illustrated in FIG. 7.
Figure 12:
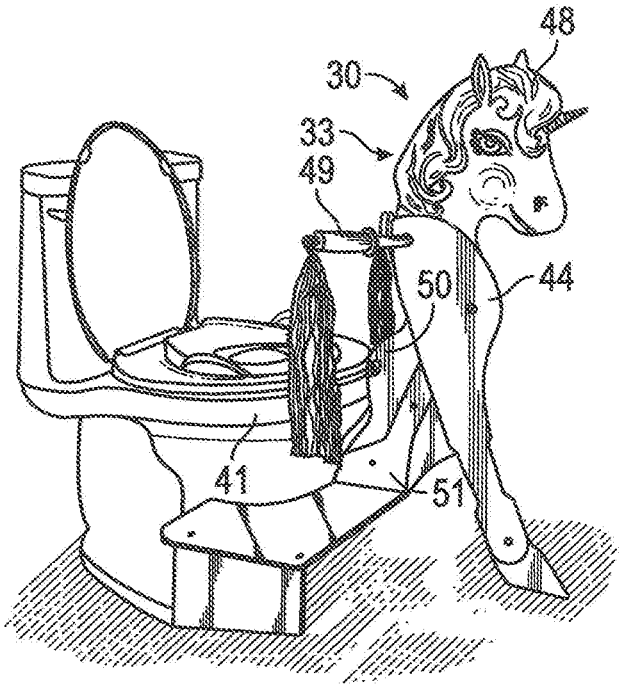
FIG. 12 is an environmental view of the toilet training device illustrated in FIG. 7 in combination with a toilet.
Figure 13:
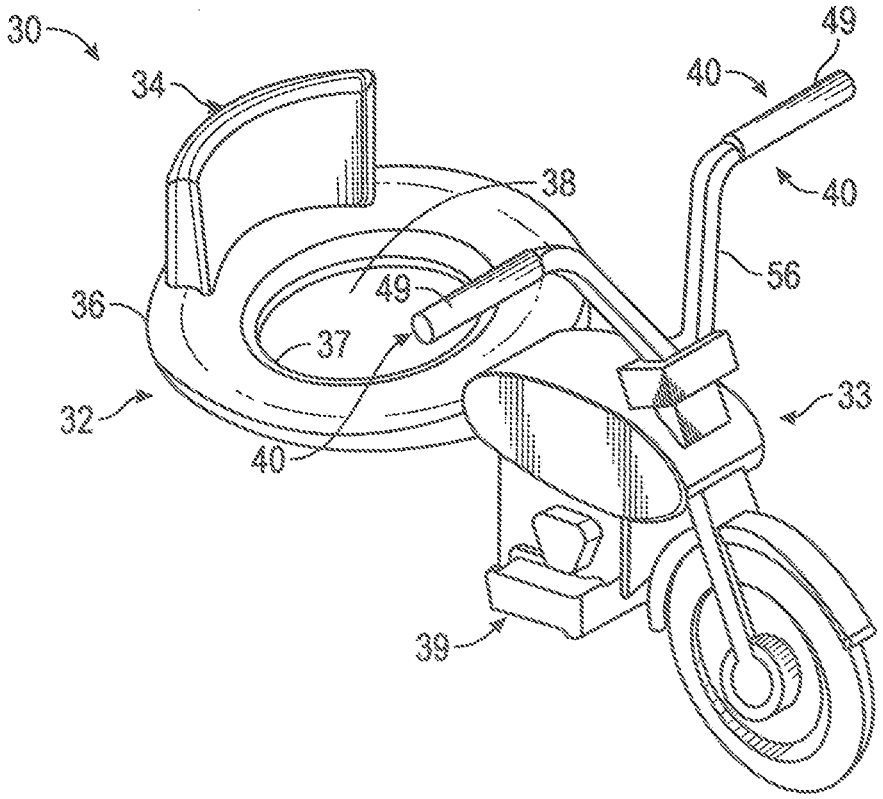
FIG. 13 is a side perspective view of a toilet training device according to an embodiment of the present invention.
Figure 14:
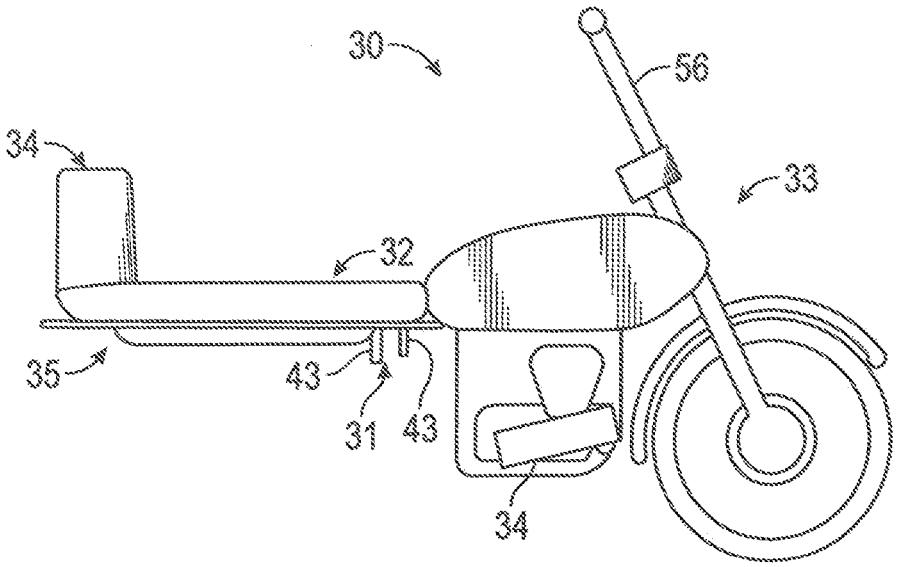
FIG. 14 is a side elevation view of the toilet training device illustrated in FIG. 13.

FIGS. 1-14 depict embodiments of the toilet training device 30 according to the present invention. In some embodiments, a child toilet seat 32 may be connected to an ornamental support device 33. The child toilet seat 32 may have an outer perimeter 36 defining any shape. In some embodiments, the outer perimeter 36 may form a circular, oblong, ovate, or the like shape. The child toilet seat 32 may also have an inner perimeter 37 defining a void 38 located within the child toilet seat 32. In some embodiments, the void 38 may be circular, oblong, ovate, or the like. A seat back 34 may be connected to a rear portion of the child toilet seat 32 and extend away from the top surface of the child toilet seat 32. The child toilet seat 32 may be positioned above or supported by a toilet bowl. The child toilet seat 32 may be placed directly on the toilet bowl basin or may be placed atop a toilet seat located above the toilet bowl basin.

Securing flanges 35 are shown, which may be disposed about the perimeter of the child toilet seat 32 and extend down from the bottom of the child toilet seat 32. In one embodiment, the securing flanges 35 may be located near the void formed by the inner perimeter of the child toilet seat. The securing flanges 35 may extend below the top surface of the toilet bowl basin or the toilet seat. These securing flanges 35 may prevent or limit lateral movement of the child toilet seat 32 with respect to the toilet bowl basin. Additionally, the securing flanges 35 may assist in aligning the void in the child toilet seat 32 with the opening on the toilet bowel, or may limit or prevent misalignment between the two.

The child toilet seat 32 may be attached to an ornamental support device 33. The child toilet seat 32 may be permanently affixed to the ornamental support device 33 or may be removably attached to the ornamental support device 33. In some embodiments, the child toilet seat 32 may be adjustably attached to the ornamental support device 33. In such an embodiment, the child toilet seat 32 may be positionable and securable to the ornamental support device 33 at more than one vertical location on the ornamental support device 33. This may allow the toilet training device 30 to be used with toilet bowl basins of differing heights. Additionally, the horizontal spacing between the child toilet seat void 38 and the ornamental support device 33 may be adjustable. In an embodiment employing an adjustable attachment of the child toilet seat 32 to the ornamental support device 33, as well as those in which the child toilet seat 32 is non-adjustably attached to the ornamental support device 33, the child toilet seat 32 may be removably attached to the ornamental support device 33.

The ornamental support device 33 may be placed on the floor and positioned in front of and adjacent a toilet. The ornamental support device 33 may be used without a child toilet seat 32. The ornamental support device 33 may be removably connected to the toilet bowl. In some embodiments, the ornamental support device 33 may be positioned adjacent to or in contact with the front of a toilet bowl basin. In embodiments of the toilet training device 30 having a child toilet seat 32, the child toilet seat 32 may extend behind the ornamental support device 33 and be positioned above or on the toilet bowl basin or toilet seat when the ornamental support device 33 is located in front of a toilet bowl basin in an operable position.

The ornamental support device 33, and the entire toilet training device 30, may be supported by the toilet bowl basin and may not contact the floor. In such an embodiment, the ornamental support device 33 may be secured to the toilet bowl basin with an attachment device 31. The ornamental support device 33 may have one or more support structures configured to contact the toilet bowl basin. In one embodiment, the ornamental support device 33 may have two support structures. The support structures may be affixed to the ornamental support device 33 at or below the upper edge of the toilet bowl basin when the ornamental support device 33 is secured to the toilet bowl basin in an operable position. The support structures may extend backward away from the front of the ornamental support device 33 to contact the outer surface of the toilet bowl basin.

The ornamental support device 33 may be adapted to rest upon a floor. In such an embodiment, the floor may support the weight of the ornamental support device 33. The ornamental support device 33 may have a centerline extending vertically through a midpoint thereof. The ornamental support device 33 may be symmetrical about the centerline. The ornamental support device 33 may be adapted to allow the centerline of the ornamental support device 33 to align with a vertical centerline of a toilet. Such an alignment may position the ornamental support device 33 in front of and centered on the toilet.

The ornamental support device 33 may be constructed from plastic, metal, wood, or like materials. The ornamental support device 33 may be constructed using components of uniform materials or any combination of materials. In one embodiment, the ornamental support device 33 may be blow molded. In such an embodiment, one or more components of the ornamental support device 33 or toilet training device 30 may be integrally formed as a monolithic unit.

The ornamental support device 33 may include a first outer member 44, a second outer member 45, and a center member 46. The first outer member 44 and second outer member 45 may oppose one another and be structured to mirror one another. The first outer member 44 and the second outer member 45 may be elongate members with opposing first and second ends. The first end may be positioned above the second end. The second ends may be positioned proximate a lower member 47 and may secure thereto. The first outer member 44 and second outer member 45 may have aligning apertures located through their thicknesses and adapted to carry one or more fasteners. The fasteners may be adapted to secure the first outer member 44 to the second outer member 45.

A center member 46 may be secured between the first outer member 44 and the second outer member 45. At least a portion of the center member 46 may be located between at least a portion of both the first outer member 44 and the second outer member 45. The center member 46 may be adapted to position the inner sides of the first outer member 44 and the second outer member 45 a uniform distance from one another. The center member 46 may have an aperture extending from a first side to an opposing second side. The aperture may be adapted to carry a fastener adapted to extend through the entirety of the aperture and secure to both the first outer member 44 and the second outer member 45.

The center member 46 may have ornamental indicia 48 secured thereto. In one embodiment, the ornamental indicia 48 may be secured to a first end of the center member 46. The first end may be located on a front or top portion of the center member 46. The ornamental indicia 48 may be located on a side of the ornamental support device 33 opposite the location of the toilet. The ornamental indicia 48 may be located on a side of the ornamental support device 33 opposite the location of the floor. In one embodiment, the ornamental indicia 48 may be adapted to resemble a headlight. In another embodiment, the ornamental indicia 48 may be adapted to resemble a head of an animal. The ornamental indicia 48 may be a separate physical component, decal, sticker, paint, carving, or the like.

The lower member 47 may be secured between the first outer member 44 and the second outer member 45. The lower member 47 may be adapted to contact and rest upon the floor when the toilet training device is in an operable position. The ornamental support device 33 may be adapted to be supported by the surface of the floor when in the operable position. In the operable position, the toilet may not support any weight of the ornamental support device 33, The lower member 47 may have an aperture extending through the lower member 47 from a first side to an opposing second side. A fastener may be configured to extend through the aperture and secure to both the first outer member 44 and the second outer member 45. The lower member 47 may be ornamental. The lower member 47 may have indicia disposed on the first or second side. The lower member 47 may have ornamental indicia secured thereto. The ornamental indicia may be secured to a side or external surface of the lower member 47. By way of example, and not as a limitation, the ornamental indicia may be a sticker, decal, paint, carving, or the like. In one embodiment, the lower member 47 may be adapted to resemble a wheel. In another embodiment, the lower member 47 may be adapted to resemble a hoof.

The ornamental support device 33 may further include a center connecting member 50. The center connecting member 50 may be a rigid, load bearing structure adapted to secure a forward portion of the ornamental support device 33 to a footrest 39 portion of the ornamental support device 33. A portion of the center connecting member 50 may be secured between opposing portions of the first outer member 44 and the second outer member 45. The center connecting member 50 may extend downward and away from the first outer member 44 and the second outer member 45 toward the back of the ornamental support device 33. The center connecting member 50 may extend from the front of the ornamental support device 33 and toward a forward portion of the toilet bowl basin when in the operable position. In one embodiment, a rear facing portion of the center connecting member 50 may contact a forward portion of the toilet bowl basin. The attachment device 31 may secure to the center connecting member 50. The spanning portion 42 of the attachment device 31 may secure to the center connecting member 50.

The ornamental support device 33 may be configured to resemble an object familiar to children. Illustrative, but not limiting, examples of possible configurations of the ornamental support device 33 include trains, all-terrain vehicles, airplanes, fire trucks, bicycles, cars, horses, trucks, motorcycles, personal watercraft, animals, vehicles, or the like.

Features of the ornamental support device 33 may include one or more footrests 39 and one or more handles 40.

The ornamental support device 33 may include a first outer connecting member 51 and a second outer connecting member 52. Each of the outer connecting members 51, 52 may have a first end abutting a portion of the respective outer members 44, 45. The first ends may be continuous linear portions of the outer connecting members 51, 52. The entirety of the first ends may abut linear edge portions of the respective outer members 44, 45. The first ends may be positioned upward, substantially away from the floor. The second ends may oppose the first ends and be located lower than the first ends when in an operable position. The first outer connecting member 51 and the second outer connecting member 52 may oppose and mirror one another. The center connecting member 50 may be secured between the outer connecting members 51, 52. The center connecting member 50 may have one or more apertures extending through the entirety of the thickness of the center connecting member 50. Fasteners may be carried by the apertures to secure the first outer connecting member 51 and the second outer connecting member 52 to the center connecting member 50.

The one or more footrests 39 may be configured to allow a user, which may be a child, to sit on the child toilet seat 32 and comfortably support his or her feet with the one or more footrests 39 while in that seated position. In some embodiments of the toilet training device 30, the one or more footrests 39 may be spaced away from the child toilet seat 32 creating a horizontal distance between the child toilet seat 32 and the one or more footrests 39. In such a configuration, the child utilizing the toilet training device 30 may be positioned with his or her legs extending in front of the child's body when the child's feet are positioned to be supported by the one or more footrests 39. The horizontal distance between the child toilet seat 32 and the one or more footrests 39 must remain small enough to allow the child's feet to be supported by the one or more footrests 39 when the child is sitting atop the child toilet seat 32 or the toilet bowl basin. The one or more footrests 39 may be spaced away from the child toilet seat 32 creating a vertical distance between the child toilet seat 32 and the one or more footrests 39. The vertical distance between the child toilet seat 32 and the one or more footrests 39 must remain small enough to allow the child's feet to be supported by the one or more footrests 39 when the child is sitting atop the child toilet seat 32 or the toilet bowl basin.

The ornamental support device 33 may include a platform 53 adapted to support a user. The platform 53 may be secured to or connected to one or more of the center connecting member 50, first outer connecting member 51, or second outer connecting member 52. The platform 53 may have a top surface opposing a bottom surface. The bottom surface may face the floor when in an operable position. The top surface may be secured in a position adjacent the second end of the first outer connecting member 51, the second end of the second outer connecting member 52, and the first end of the center connecting member 50. The second ends of the first and second outer connecting members 51, 52 and the first end of the center connecting member 50 may be continuous, linear sections. These ends may align with corresponding linear sections on the top surface of the platform 53. The entirety of the first outer connecting member 51 second end may be adjacent the top surface of the platform 53. The entirety of the second outer connecting member 52 second end may be adjacent the top surface of the platform 53. The entirety of the center connecting member 50 first end may be adjacent the top surface of the platform 53. A first side support 54 and a second side support 55 may be secured to the platform 53. The first side support 54 may secure to a bottom side of the platform 53 and be configured to extend downward, toward the floor, when in an operable position. A first end of the first side support 54 may secure to the platform 53 on the bottom side. A second end of the first side support 54 may contact the floor. A first end of the second side support 55 may secure to the platform 53 on the bottom side. A second end of the second side support 55 may contact the floor. The floor may support all or a portion of the weight of the toilet training device 30 at the location where one or more of the side supports 54, 55 contact the floor.

In some embodiments, the one or more footrests 39 may be configured as pegs extending from or integrated into the ornamental support device 33. The one or more footrests 39 may be adapted to extend away from both sides of a vertical centerline of the ornamental support device 33. One of the one or more footrests 39 may extend from each side of the ornamental support device 33. The one or more footrests 39 may also be configured as platforms extending from or integrated into the ornamental support device 33. The one or more footrests 39 may be a single platform, peg, or other component. The one or more footrests 39 may be configured parallel to the ground upon which the toilet training device 30 rests or parallel to the top surface of the child toilet seat 32 or toilet bowl basin. The one or more footrests 39 may be configured at an angle to the ground upon which the toilet training device 30 rests or at an angle to the top surface of the child toilet seat 32 or toilet bowl basin. The angle of the one or more footrests 39 may be such that the child's toes are supported at a position higher than the child's heels. The one or more footrests 39 may be two separate platforms, pegs, or other components. In embodiments having two separated footrests 39, each footrest 39 may be symmetrically disposed on opposing sides of the ornamental support device 33.

The one or more footrests 39 may be adjustably connected or affixed to the ornamental support device 33. In embodiments in which the one or more footrests 39 are adjustably connected or affixed to the ornamental support device 33, the vertical and/or horizontal distance between the one or more footrest 39 and the child toilet seat 32 or top surface of the toilet bowl basin may be adjusted. Additionally, in such configurations, the angle of the one or more footrests 39 with respect to the ground upon which the toilet raining device 30 rests, the child toilet seat 32, or the top surface of the toilet bowl basin may be adjusted. In embodiments utilizing support structures, the footrests may be integrated with the support structures.

The ornamental support device 33 may have one or more handles 40. The one or more handles 40 may be secured to the ornamental support device 33 and extend upward and/or laterally from the ornamental support device 33. The one or more handles 40 may be located at a position higher than the child toilet seat 32, toilet seat, or the top surface of the toilet bowl basin. The one or more handles may be configured to provide a vertical spacing between the child toilet seat 32, the top surface of the toilet bowl basin, or toilet seat large enough to position the child's hands above his or her waist when seated on the child toilet seat 32 or toilet seat and grasping the one or more handles 40. The one or more handles may be configured to provide a horizontal spacing between the front edge of the inner perimeter 37 or outer perimeter 36 of the child toilet seat 32 large enough to position the child's hands or arms in front of his or her torso when seated on the child toilet seat 32 or toilet seat and grasping the one or more handles 40.

The handle 40 may include a handlebar 56 adapted to extend through both a first aperture located in the first outer member 44 and a second aperture located in the second outer member 45. Handle grips 49 may be adapted to be carried by each end of the handlebar 56. The handle grips 49 may be hollow, elongate members with an inner diameter approximating the outer diameter of the ends of the handlebar 56. The handle grips may be adapted to be grasped by a hand of the user.

In one embodiment, the one or more handles 40 may be configured to simulate a steering wheel. By way of illustration and not as a limitation, the one or more handles 30 may be configured as a steering wheel in embodiments in which the ornamental support device 33 is configured to resemble a train, all-terrain vehicle, airplane, fire truck, car, truck, motorcycle, personal watercraft, other vehicle, or the like. In such an embodiment, the one or more handles 40 may be rotatably affixed to the ornamental support device 33.

The ornamental support device 33 may be configured to position the one or more handles 40 and the one or more footrests 39 at essentially the same or similar horizontal distances from the front of the toilet bowl basin when the toilet training device 30 is positioned in front of a toilet.

In some embodiments, a round structure, which may resemble a wheel, or other ornamental item, which may resemble and animal hoof, may be affixed to or integrally joined to the front of the ornamental support device 33. Such a structure may be the lower member 47. By way of illustration and not as a limitation, one or more wheel-like structures or animal foot-like structures may be affixed to the front of the ornamental support device 33 when the ornamental support device 33 is configured to resemble a train, all-terrain vehicle, airplane, fire truck, bicycle, car, truck, motorcycle, other vehicle, unicorn, horse, dog, cat, rabbit, frog, duck, or the like.

In some embodiments, an electronic entertainment device may be affixed to the ornamental support device 33. There may be an electronic entertainment device support structure disposed on the ornamental support device 33. The electronic entertainment device support structure may be a recess into which an electronic entertainment device may be securely placed. The ornamental support device 33 may have an integral electronic entertainment device, such as, by way of example, and not as a limitation, a screen, game, or the like. The ornamental support device 33 may include an electronic connector, to which an external electronic device may be connected. In such a connected configuration, content from an external electronic device may be displayed on a screen of the ornamental support device 33.

In one embodiment, no child toilet seat may be secured to the ornamental support device 33. In such an embodiment, the ornamental support device 33 may be secured to a toilet bowl basin using an attachment device 31 or no attachment device 31 may be used and the ornamental support device 33 may be positioned proximate a toilet bowl basin.

One possible embodiment of the attachment device 31 may attach to the back of the ornamental support device 33. The attachment device may be secured to the ornamental support device and may be adapted to removably secure to a toilet bowl basin rim 41. A spanning portion 42 of the attachment device 31 may secure to the ornamental support device 33 and extend behind the ornamental support device 33 for a distance approximately equal to the width of a toilet bowl basin rim 41. The spanning portion 42 may be longer than the width of the toilet bowl basin rim 41 in embodiments in which the spanning portion 42 must extend a distance from the ornamental support device 33 before reaching the location of the toilet bowl basin rim 41. A securing portion 43 of the attachment device 31 may connect to the spanning portion 42 forming a 90-degree angle with the spanning portion 42. The securing portion 43 may extend downward into or toward the toilet bowl basin capturing the toilet bowl basin rim 41 between the securing portion 43 and the ornamental support device 33.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

That which is claimed is:

1. A toilet training device comprising:

an ornamental support device adapted to rest upon a floor with a centerline of the ornamental support device aligned with a centerline of a toilet, wherein the ornamental support device further comprises:

a footrest adapted to extend away from both sides of a centerline of the ornamental support device, a first outer member, a second outer member opposing the first outer member, a center member wherein at least a portion of the center member is secured between at least a portion of the first outer member and the second outer member, and a lower member adapted to contact the floor and secured between the first outer member and the second outer member; and an attachment device secured to the ornamental support device and adapted to removably secure to a toilet bowl basin rim.

2. The toilet training device according to claim 1 wherein the attachment device further comprises:

a spanning portion secured to the ornamental support device; and a securing portion secured to the spanning portion and adapted to extend toward a toilet bowl basin.

3. The toilet training device according to claim 1 wherein the center member has ornamental indicia secured thereto.

4. The toilet training device according to claim 1 wherein the lower member has ornamental indicia secured thereto.

5. The toilet training device according to claim 1 comprising:

a handle secured to the ornamental support device and comprising:

a handlebar adapted to extend through the first outer member and the second outer member;

a first handle grip located on a first end of the handlebar; and a second handle grip located on a second end of the handlebar;

wherein the first handle grip and the second handle grip are hollow, elongate members adapted to carry an end portion of the handlebar and be grasped by a hand of a user.

6. The toilet training device according to claim 1 wherein the ornamental support device further comprises:

a center connecting member;

wherein only a portion of the center connecting member is secured between a portion of the first outer member and a portion of the second outer member; and wherein the center connecting member extends downward away from the first outer member and the second outer member.

7. The toilet training device according to claim 6 wherein the attachment device further comprises:

a spanning portion secured to the center connecting member, and a securing portion secured to the spanning portion and adapted to extend into a toilet bowl basin.

8. The toilet training device according to claim 6 wherein the ornamental support device further comprises:

a first outer connecting member having a first outer connecting member first end abutting a portion of the first outer member along the entirety of the first outer connecting member first end; and a second outer connecting member having a second outer connecting member first end abutting a portion of the second outer member along the entirety of the second outer connecting member first end;

wherein the center connecting member is secured between the first outer connecting member and the second outer connecting member.

9. The toilet training device according to claim 8 wherein the ornamental support device further comprises:

a platform adapted to support a user;

wherein a top surface of the platform is adjacent a first outer connecting member second end of the first outer connecting member;

wherein the top surface of the platform is adjacent a second outer connecting member second end of the second outer connecting member; and wherein a first end of the center connecting member is adjacent the top surface of the platform.

10. The toilet training device according to claim 9 wherein the top surface of the platform is adjacent the first outer connecting member second end of the first outer connecting member along an entirety of the first outer connecting member second end;

wherein the top surface of the platform is adjacent the second outer connecting member second end of the second outer connecting member along an entirety of the second outer connecting member second end; and wherein the first end of the center connecting member is adjacent the top surface of the platform along an entirety of the first end of the connecting member.

11. The toilet training device according to claim 9 further comprising:

a first side support secured to a bottom side of the platform and adapted to contact the floor; and a second side support secured to the bottom side of the platform and adapted to contact the floor.

12. A toilet training device comprising:

a first outer member;

a second outer member opposing the first outer member;

a center member wherein at least a portion of the center member is secured between at least a portion of the first outer member and the second outer member;

a center connecting member wherein only a portion of the center connecting member is secured between a portion of the first outer member and a portion of the second outer member;

an attachment device secured to the center connecting member and adapted to removably secure to a toilet bowl basin rim;

a first outer connecting member having a first outer connecting member first end abutting a portion of the first outer member along the entirety of the first outer connecting member first end;

a second outer connecting member having a second outer connecting member first end abutting a portion of the second outer member along the entirety of the second outer connecting member first end; a first side support secured to a bottom side of the platform and adapted to contact the floor; and a second side support secured to the bottom side of the platform and adapted to contact the floor;

wherein the center connecting member is secured between the first outer connecting member and the second outer connecting member; and wherein the center connecting member extends downward away from the first outer member and the second outer member.

13. The toilet training device according to claim 12 wherein the attachment device further comprises:

a spanning portion secured to the center member, and a securing portion secured to the spanning portion and adapted to extend in to a toilet bowl basin.

14. The toilet training device according to claim 12 wherein the toilet training device further comprises:

a lower member secured between the first outer member and the second outer member and wherein the lower member is adapted to contact the floor.

15. The toilet training device according to claim 14 wherein the center member has ornamental indicia secured thereto and the lower member has ornamental indicia secured thereto.

16. The toilet training device according to claim 12 further comprising:

a handlebar adapted to extend through the first outer member and the second outer member;

a first handle grip located on a first end of the handlebar; and a second handle grip located on a second end of the handlebar;

wherein the first handle grip and the second handle grip are hollow, elongate members adapted to carry an end portion of the handlebar and be grasped by a hand of a user.

17. The toilet training device according to claim 12 wherein the ornamental support device further comprises:

a platform adapted to support a user;

wherein a top surface of the platform is adjacent a first outer connecting member second end of the first outer connecting member along an entirety of the first outer connecting member second end;

wherein the top surface of the platform is adjacent a second outer connecting member second end of the second outer connecting member along an entirety of the second outer connecting member second end; and wherein a first end of the center connecting member is adjacent the top surface of the platform along an entirety of the first end of the connecting member.

18. A toilet training device comprising:

a first outer member;

a second outer member opposing the first outer member;

a center member having ornamental indicia disposed thereon, wherein at least a portion of the center member is secured between at least a portion of the first outer member and the second outer member;

a center connecting member wherein only a portion of the center connecting member is secured between a portion of the first outer member and a portion of the second outer member;

an attachment device secured to the center connecting member and adapted to removably secure to a toilet bowl basin rim, wherein the attachment device further comprises:

a spanning portion secured to the center member, and a securing portion secured to the spanning portion and adapted to extend in to a toilet bowl basin;

a first outer connecting member having a first outer connecting member first end abutting a portion of the first outer member along the entirety of the first outer connecting member first end;

a second outer connecting member having a second outer connecting member first end abutting a portion of the second outer member along the entirety of the second outer connecting member first end; a first side support secured to a bottom side of the platform and adapted to contact the floor;

a lower member secured between the first outer member and the second outer member, wherein the lower member is adapted to contact the floor and has ornamental indicia disposed thereon;

a second side support secured to the bottom side of the platform and adapted to contact the floor;

a handlebar adapted to extend through the first outer member and the second outer member;

a first handle grip located on a first end of the handlebar;

a second handle grip located on a second end of the handlebar; and a platform adapted to support a user;

wherein a top surface of the platform is adjacent a first outer connecting member second end of the first outer connecting member along an entirety of the first outer connecting member second end;

wherein the top surface of the platform is adjacent a second outer connecting member second end of the second outer connecting member along an entirety of the second outer connecting member second end;

wherein a first end of the center connecting member is adjacent the top surface of the platform along an entirety of the first end of the connecting member;

wherein the first handle grip and the second handle grip are hollow, elongate members adapted to carry an end portion of the handlebar and be grasped by a hand of the user;

wherein the center connecting member is secured between the first outer connecting member and the second outer connecting member; and wherein the center connecting member extends downward away from the first outer member and the second outer member.

* * * * *